US007377282B2

(12) United States Patent
O'Dwyer

(10) Patent No.: US 7,377,282 B2
(45) **Date of Patent: *May 27, 2008**

(54) NAIL POLISH REMOVAL TOOL

(75) Inventor: Barry O'Dwyer, Harrisville, NH (US)

(73) Assignee: Bear-Ink Corporation, Harrisville, NH (US)

( * ) Notice: Subject to any disclaimer, the term of this patent is extended or adjusted under 35 U.S.C. 154(b) by 228 days.

This patent is subject to a terminal disclaimer.

(21) Appl. No.: 11/219,210

(22) Filed: Sep. 2, 2005

(65) Prior Publication Data

US 2006/0000483 A1 Jan. 5, 2006

Related U.S. Application Data

(63) Continuation-in-part of application No. 10/243,877, filed on Sep. 13, 2002, now Pat. No. 6,990,984.

(51) Int. Cl.
*A45D 29/05* (2006.01)
*A45D 29/18* (2006.01)

(52) U.S. Cl. ..... 132/73.6; 132/74.5; 132/76.4

(58) Field of Classification Search ..... 132/74.5, 132/73.6, 76.4, 73.5, 75.3, 75.6; 15/22.1, 15/97, 97.1; 451/910, 270, 271, 357, 356
See application file for complete search history.

(56) References Cited

U.S. PATENT DOCUMENTS 233,067 A 10/1880 Buzzell
3,316,922 A 5/1967 Seidler
3,357,033 A 12/1967 Sawyer
4,032,803 A 6/1977 Durr et al.
4,176,454 A 12/1979 Hatter et al.
4,295,240 A 10/1981 Lex
4,307,738 A 12/1981 Barns
4,703,536 A * 11/1987 Livneh ..... 15/97.1
5,125,398 A 6/1992 Horton
5,190,456 A 3/1993 Hasegawa
5,665,141 A 9/1997 Vago
5,697,230 A 12/1997 Ender et al.
5,921,250 A 7/1999 Rhea et al.
5,992,422 A 11/1999 Ivory
6,116,248 A 9/2000 Walker
6,234,180 B1 5/2001 Davis et al.
6,314,965 B1 11/2001 Walker
6,405,735 B1 6/2002 Dockery
6,536,065 B2 3/2003 Forrest
6,990,984 B2 * 1/2006 O'Dwyer ..... 132/74.5

* cited by examiner

*Primary Examiner*—Robyn Doan
(74) *Attorney, Agent, or Firm*—Cesari and McKenna, LLP

(57) ABSTRACT

A hand held nail polish removal tool includes a housing having a main body connected by an elongated neck to a head. An abrasive member is removably attached to the head and the tool contains a motor or transducer for causing the abrasive member to move so that when the abrasive member is positioned against a finger or toe nail, the abrasive member will abrade away any polish on the nail. The polish removal process may be accelerated by applying a solvent to the abrasive member. This may be done by dipping that member in a solvent or by including a solvent in the member or by incorporating a solvent dispensing system in the housing which allows a solvent to be delivered via the head to the member's abrasive surface. Preferably, the tool is powered by a rechargeable battery in the housing. Various different abrasive cover members for attachment to the head are also disclosed.

20 Claims, 3 Drawing Sheets

NAIL POLISH REMOVAL TOOL

CROSS-REFERENCE TO RELATED APPLICATION

This application is a continuation-in-part of Ser. No. 10/243,877, filed Sep. 13, 2002, now Patent 6,990,984.

BACKGROUND OF THE INVENTION

This invention relates to a grooming device. It relates more particularly to a hand held tool for the removal of nail polish from finger and toe nails.

The removal of nail polish is a tedious task. The process usually involves wetting a pad or cotton swab with a volatile solvent and rubbing the coating repeatedly with the pad or swab until the polish is removed. The procedure is also fairly messy because the nail polish becomes soft and finds it way into crevices in the cuticle. Very often the solvent must be reapplied to the pad or swab and more than one swab must be used in order to remove the polish completely from the nail. This may take a good hour to completely clean a set of nails manually during which time one is exposed to the toxic fumes and annoying smell of the solvent.

There have been attempts to make the nail cleaning process more efficient. For example, there are devices that enable one to bathe all of the nails in a polish removing solution in order to facilitate the rubbing away of the polish. We are also aware of devices that brush the nails while they are immersed in a solvent in order to remove the polish. However, these devices take up space, they are prone to spilling, they require the use of an excessive amount of solvent and they are somewhat hazardous to use in confined spaces because of the toxic fumes given off by the solvent.

Also, when such devices are used to remove of polish from toe nails, some people find it difficult to bend down and scrub the softened polish from the toe nails.

SUMMARY OF THE INVENTION

Accordingly, the present invention aims to provide a hand held tool to facilitate the removal of polish from finger and toe nails.

Another object of the invention is to provide a finger and toe nail-cleaning device in the nature of an electrical tool which relies on a moving pad with or without a solvent to remove the polish.

Still another object of the invention is to provide a nail polish removal tool which is easy to use even by aged and infirm individuals.

A further object of the invention is to provide such a tool which increases the reach of the user while cleaning the nails.

Other objects of the invention will, in part, be obvious and will, in part, appear hereinafter.

The invention accordingly comprises the features of construction, combination of elements and arrangement of parts which will be exemplified in the construction hereinafter set forth and the scope of the invention will be indicated in the claims.

Briefly, my nail polish removal tool is a small compact power tool having a main body leading to a narrow neck terminated by a small head having a working surface which may be rapidly moved by an electrically driven prime mover inside the body. The working surface is normally covered by an abrasive member in the nature of a scouring pad or swab. When the tool is in use, the abrasive member thereon is placed against the surface of a finger or toe nail with the result that the rubbing action of the abrasive member abrades away any polish or other covering on the nail. The surface of the abrasive member is such that the elements of that moving surface are able to penetrate into cracks and crevices enabling the tool to clean even around the cuticle.

Preferably, the tool is used with a polish removing agent or solvent. As we shall see, the solvent may be applied externally to the abrasive member or incorporated into the member itself. In an especially preferred embodiment, the tool may contain a supply of solvent which is delivered under operator control to the abrasive member via the tool head. The combination of the moving abrasive member and solvent is particularly effective in removing multiple coatings of polish from finger and toe nails.

As will become apparent, the tool described herein is easy to use and is configured so that it extends the user's reach so that it makes the removal of polish from toe nails much easier for those who have difficulty bending over. The tool is easily adaptable for occasional home use or for intensive use in a salon, clinic, hospital or the like where time is of the essence. Indeed, the tool should greatly reduce the overall time and effort spent on removing polish and other coverings from finger and toe nails.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF AN ILLUSTRATIVE EMBODIMENTS

Figure 1:
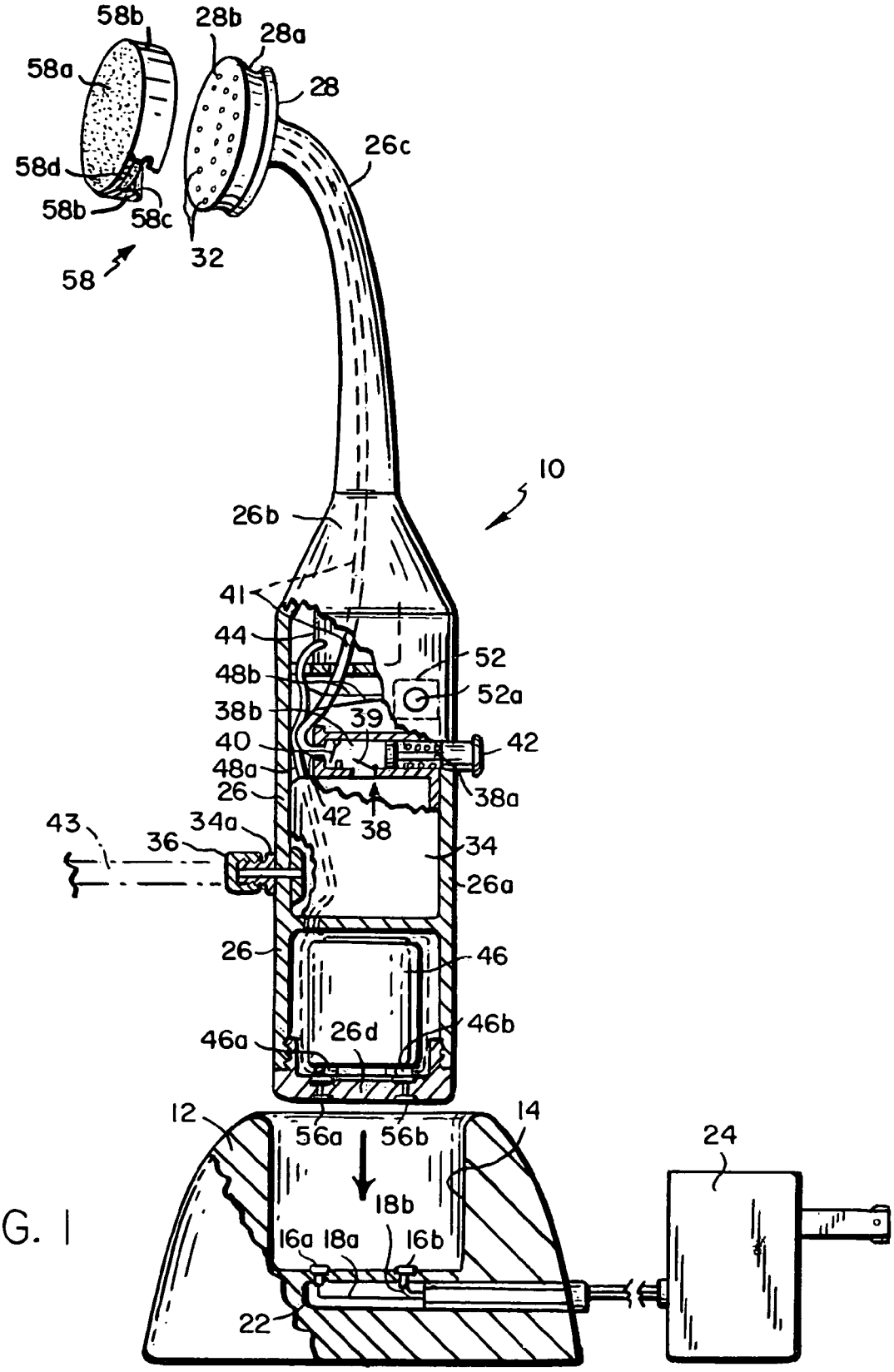
FIG. 1 is an elevational view with parts broken away showing a hand held nail polish removal tool incorporating the invention and used in conjunction with a first type of cover member.

Referring now to FIG. 1, a battery operated nail polish removal tool shown generally at 10 is shown partially seated in a recharging stand 12 having a vertical shaft or receptacle 14 for receiving the lower end of tool 10. A pair of contacts 16*a* and 16*b* at the bottom of receptacle 14 are connected by wires 18*a* and 18*b* extending along a passage 22 in stand 12. Wires 18*a* and 18*b* are connected to a standard AC/DC converter 24 which, when plugged into a standard AC outlet, delivers DC power, e.g. 12 volts, to contacts 16*a* and 16*b*. When tool 10 is fully seated in receptacle 14, battery recharging power may be delivered to the tool.

Still referring to FIG. 1, tool 10 comprises a hollow housing 26 made of a suitable impact-resistant, electrically insulating plastic material such as high density polyethylene, polypropylene or the like. Housing 26 has a generally cylindrically main body 26*a* which transitions at a shoulder portion 26*b* to an elongated smaller diameter tubular neck portion 26*c*. A generally discoid hollow head 28 having a circumfrential groove 28*a* is mounted on its axis to the free end of neck portion 26*c*. Preferably neck portion 26*c* is curved and head 28 is angled relative to housing 26 such that when one holds the tool 10 at housing body 26*a*, the working face or surface 28*b* of head 28 may be placed flush against the surface of a finger or toe nail. While the head surface 28*b* is shown as being flat, it may be curved to conform more to the contour of a nail. For the same reason, surface 28*b* may be elliptical instead of round as shown. In any event, the illustrated head 28 on tool 10 is hollow and its surface 28*b* is provided with a multiplicity of tiny through holes 32 which are distributed over that surface.

Still referring to FIG. 1, tool 10 includes a relatively large container 34 which is situated in housing body 26*a*. Container 34 may be filled with a conventional nail polish solvent via a fill inlet 34*a* extending through the side wall of housing body 26*a*. Inlet 34*a* may be closed by a cap 36. Alternatively, container 34 may be in the form of a replaceable vented cartridge or flexible pouch which may be installed via a suitable door (not shown) in the wall of housing portion 26*a*.

Container 34 includes an integral piston pump 38 at the top of the container which pump may be of a conventional design. The illustrated pump includes a spring-loaded piston 38*a* which when retracted draws solvent from container 34 via a first check valve 39 into piston chamber 38*b*. When the piston 38*a* is extended, the fluid in the chamber 38*b* is delivered via a second check valve 40 to a tube 41 which leads from pump 38 to the interior of head 28. Piston 38*a* is moved to its extended position in opposition to the spring bias by a user pressing on a button 42 in the side of housing body 26*a*. Once the head 28 is primed with solvent, each additional push of button 42 results in solvent exiting the head 28 via holes 32. Preferably, the holes of 32 are small enough and their number is small enough so that the head will remain primed with solvent for a relatively long time between uses and solvent will not leak from head 28 when the tool is laid down on its side.

When tool 10 is being used in a salon or the like, the cap 36 may be removed and the inlet 34*a* connected to a flexible conduit 43 shown in phantom in FIG. 1 and extending to a large volume solvent source (not shown). If container is a cartridge as described above, it may be charged with a gas to expel the solvent through the tube 41 when a valve button is depressed.

As shown in FIG. 1, tool 10 also includes a prime mover, namely an electric motor-driven vibrator 44 which is situated in the housing body 26*a* above pump 38. The vibrator 44 may be of the type used in conventional electric toothbrushes and arranged so that it vibrates the neck portion 26*c* and/or the head 28 in the same manner as the necks and heads of standard electric toothbrushes. Vibrator 44 receives its power from a rechargeable battery 46 located in housing body 26*a* below container 34. Battery 46 has a contact 46*a* connected by a wire 48*a* to vibrator 44. A second battery contact 46*b* is connected to the vibrator by a wire 48*b* which is diverted on its way to vibrator 44 to a switch 52 mounted in the wall of housing body 26*a* adjacent to button 42. The switch has an actuator 52*a* which projects through the wall of housing body 26. When depressed, actuator 52*a* closes the switch so the power from battery 46 is delivered to vibrator 44 with the result that head 28 vibrates rapidly more or less in the plane of its surface 28*b*.

Battery contacts 46*a* and 46*b* are also connected to external contacts 56*a* and 56*b*, respectively, mounted in a removable bottom wall 26*d* of housing 26. When the tool 10 is fully seated in the receptacle 14 of recharge stand 12, the two contacts 56*a* and 56*b* connect to the stand contacts, 16*a*, 16*b* respectively so that DC power from the converter 24 will be delivered to battery 46.

When tool 10 is in use, its head 28 is usually covered by an abrasive cover member shown generally at 58 in FIG. 1. Cover member 58 should be shaped to conform to the shape of head 28. It includes a generally flat porous rubbing surface 58*a* which is preferably of a woven nylon material similar to a conventional scouring pad. Cover member 58 also includes a skirt 58*b* which extends from the edge of surface 58*a* and is adapted to engage around head 28. Skirt 58*b* is provided with an internal rib 58*c* which can engage in groove 28 of a head 28 to secure the cover member to the head so that surface 58*a* overlies the openings 32 in the head. Alternatively, an elastic may be hemmed into the edge of skirt 58*b* and adapted to engage around the head 28.

Prior to using tool 10, the head 28 is primed with solvent by repeatedly depressing button 42 until solvent issues from holes 32 and penetrates the surface 58*a* of cover member 58. To help maintain the surface 58*a* in a wetted condition, a thin layer of open cell foam material may be provided on the inside of surface 58*a* as is shown at 58*d* in FIG. 1. Once the head 28 is primed with solvent, the tool 10 may be manipulated to position the cover member 58 against the nail to be cleaned. Subsequent depression of switch actuator 52*a* energizes vibrator 44 causing head 28 and the cover member 58 thereon to vibrate rapidly. This rapid vibration works the solvent present at the cover member surface 58*a* into the nail polish layer thereby softening that layer and allowing it to be abraded away by surface 58*a*, elements of which are able to penetrate into depressions and crevices at the nail cuticle. Resultantly, tool 10 allows the nail to be cleaned thoroughly in a minimum amount of time.

Figure 2:
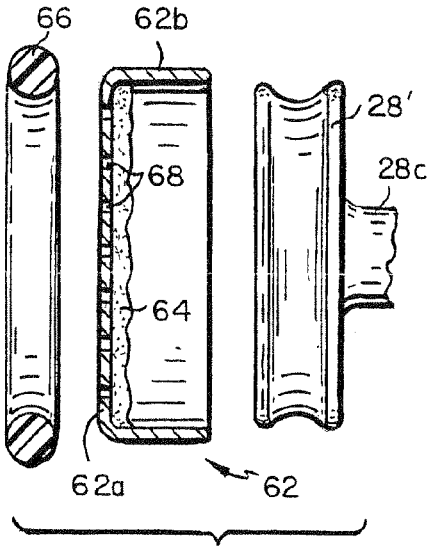
FIG. 2 is an exploded side elevational view, with parts broken away, of the tool equipped with a second type of cover member.

FIG. 2 shows generally at 62 a somewhat different cover member which may be used with a tool such as tool 10. Like cover member 58, cover member 62 has a perforate scouring or abrasive surface 62*a* and a skirt 62*b* arranged to engage around a grooved tool head 28'. In addition, however, the cover member 62 contains a supply of solvent gel 64 backing up the surface 62*a*. When the cover member is fitted on head 28', the gel layer 64 is engaged by the working surface of head 28'. The cover member may be held in place on head 28' by an O-ring 66 which presses the skirt 62*b* into the circumferential groove in the head 28'. Of course, in lieu of O-ring 66, the cover member 62 may be provided with an internal rib similar to rib 58*c* in FIG. 1.

When using my tool with the cover member 62, the pressure of the tool head 28' against the nail forces the solvent gel 64 through tiny holes 68 in the cleaning member surface 62*a* so that that surface and the nail which it contacts are wetted with solvent. Resultantly when head 28' is vibrated, nail polish is removed in the same efficient manner described above in connection with FIG. 1. Also, since the tool itself is not delivering solvent, head 28' may be solid and the solvent delivery system in the tool, i.e. container 34, pump 38 and tube 41 may be eliminated, thereby reducing the cost of the tool.

Once the polish is removed from the nails using tool 10, those nails may be buffed by substituting for the cover member 58 or 62 a similarly shaped cover member having a smooth surface and the tool used without the application of solvent.

Figure 3:
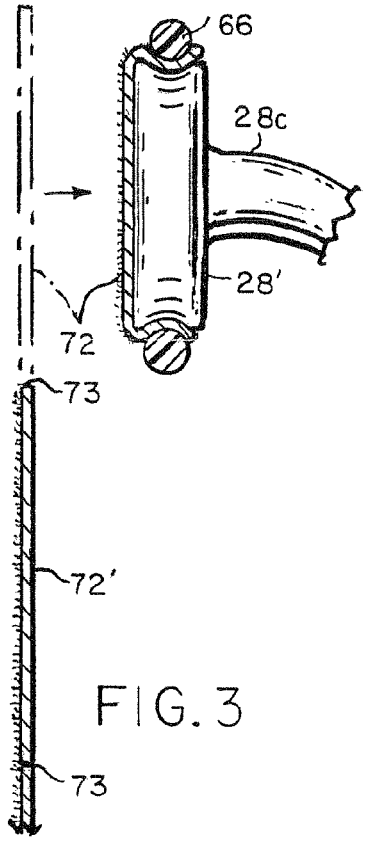
FIG. 3 is a similar view of a third type of cover member which may be used with the FIG. 1 tool.

FIG. 3 illustrates generally at 72 still another type of cover member which may be used with the FIG. 1 tool 10 when the tool is not supplying solvent. In this case, cover member 72 is a segment of woven nylon scouring or abrasive material separated at a parting line 73 from a segmented strip or roll 72' of such material. The cover member 72 from strip 72' may be gathered around head 28' (or 28) and held in place by an O-ring 66 as shown in FIG. 3.

Figure 4:
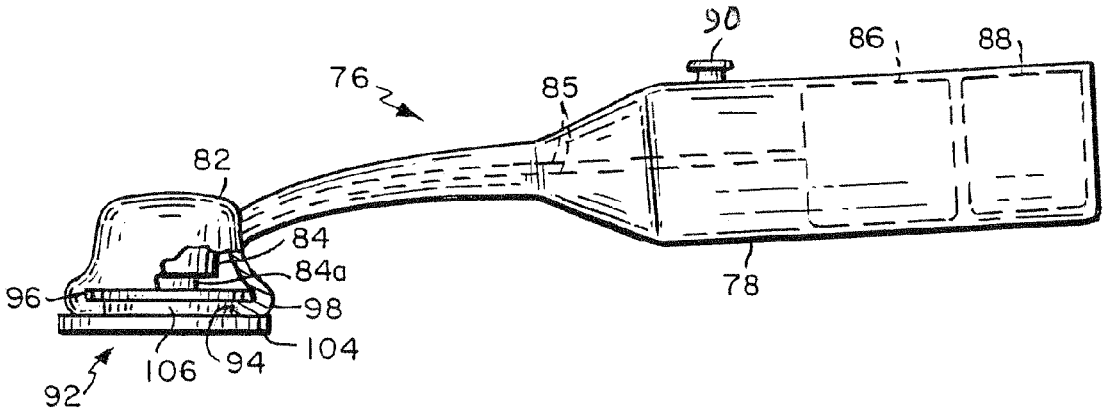
FIG. 4 is a view similar to FIG. 1 of a second tool embodiment.

Turn now to FIG. 4 which shows generally at 76 a hand held nail polish removal tool that cleans ultrasonically. Tool 76 includes a hollow housing 78 which supports a hollow head 82 containing an ultrasonic transducer 84 as the prime mover. Transducer 84 is connected electrically by wires 85 to a conventional signal generator 86 including a driver in housing 78, the generator being powered by a rechargeable battery 88 in the housing. Once a switch button 90 in the side of housing 78 is depressed, unit 86 delivers a high frequency, e.g. greater than 17 kHz, driving signal to transducer 84 so that the working surface or head 84*a* of transducer 84 vibrates ultrasonically.

The ultrasonic tool 76 is used in conjunction with a cleaning member shown generally at 92. For this, the head 82 has a bottom opening 94 and an end slot 96 which leads to a pair of laterally spaced apart parallel rails 98, 98 adjacent bottom opening 94, these slotted rails forming a keyway in head 82.

Member 92 is shaped and arranged to slide into slot 96 and key into head 82. More particularly, cleaning member 92 comprises an abrasive scrubbing strip 104 which is supported by a support 106 in the form of a key enabling member 92 to be slid endwise into the end of housing 82 through slot 96 so that the upper surface of support 106 is engaged by the transducer head 84*a* and the abrasive strip 104 hugs the underside of housing 52 as shown in FIG. 4. In accordance with the invention, the cleaning member 92, and particularly its support 106, is rigid so that when transducer 84 is operative, the vibrations produced thereby are coupled via support 106 to strip 104 and thence to the nail contacted by that strip.

When using tool 76 to clean finger and toe nails if it is desired to apply solvent to the nails, that may be done by momentarily dipping the cleaning member 92 in solvent or by modifying the tool 76 to include the solvent dispensing system illustrated in FIG. 1.

In some tool models it may be desirable to make the head or neck separable from the main body of the tool to facilitate replacement of the head and/or repair of the tool. In this event, a suitable connection or joint may be provided in housings 26 and 78 between the neck portion and the housing main body, e.g. a bayonet or pin-in-slot connection.

Figure 5:
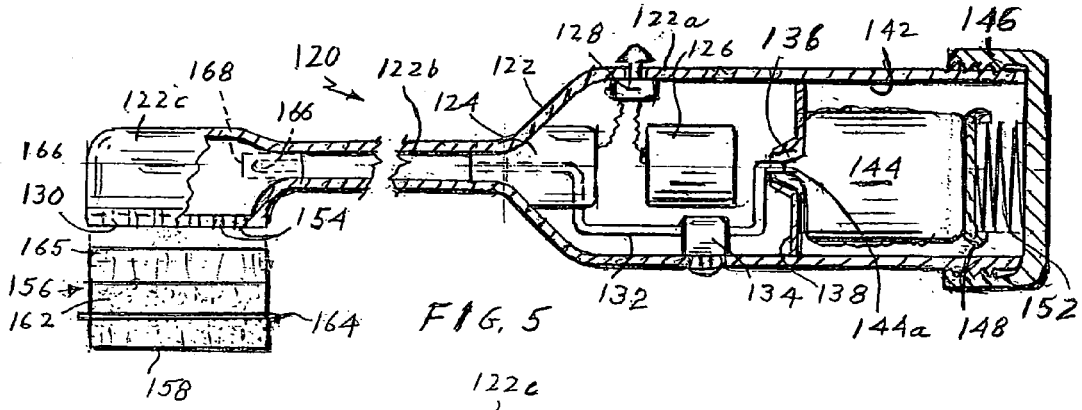
FIG. 5 is a view similar to FIG. 1 of yet another tool embodiment.
Figure 6:
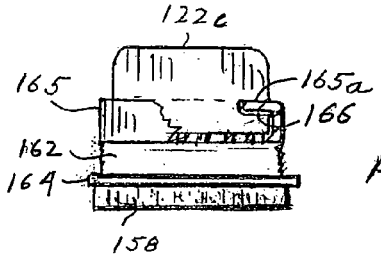
FIG. 6 is an end elevational view with parts broken away showing the swab component of the FIG. 5 tool.

Refer now to FIGS. 5 and 6 which show another tool embodiment 120 comprising a housing 122 having a main body 122*a* and a smaller diameter elongated neck 122*b* leading to a head 122*c*. Like the tool depicted in FIG. 4, the head 122*c* is caused to vibrate. However, instead of placing the transducer or vibrator in the head as in FIG. 4, a known transducer 124 is located in the housing body 122*a* and extends into neck 122*b* so that when activated, the transducer causes the neck 122*b* as well as head 122*c* to vibrate. The transducer 124 is powered by a rechargeable battery 126 in main body 122*a* which is connected to the transducer by way of a finger-activated switch 128 mounted in the wall of housing 122.

Also, unlike the tool 76 in FIG. 4, the tool 120 is able to deliver a solvent to the working surface 130 of head 122*c* as the head is vibrated. More particularly, both neck 122*b* and head 122*c* are hollow. A tube 132 leads from the interior of the neck by way of a finger-operated valve 134 mounted to the wall of housing 122 to a female fitting 136 centered in a partition 138 in main body 122*a*. The partition 138 forms one wall of a compartment 142 that is adapted to contain a collapsible bag or pouch 144. Pouch 144 includes a male outlet 144*a* which is shaped and arranged to plug into fitting 136 to form fluid-tight connection between the pouch and the rear end of tube 132.

After pouch 144 is inserted into compartment 142, the right-hand end of that compartment may be closed by an internally threaded cap 146 which is screwed onto the right-hand end of housing 122. As shown in FIG. 5, a shoe 148 is mounted to the inside of cap 146 by way of a spring 152 so that when the cap is screwed onto the threaded end of the housing, the shoe exerts pressure on, and tends to collapse, the pouch 144. The valve 134 is normally closed. However, when opened by finger pressure, the solvent in pouch 144 is free to flow via tube 132 and neck 122*b* to the tool head 122*c*.

As shown in FIG. 5, small perforations 154 are provided in the wall of head 122*c* at working surface 130 so that solvent can flow from the interior of the head to that working surface. As with the other tool embodiments described herein, the tool 120 includes an abrasive member that covers the working surface 130 of the tool head. While that abrasive member may be permanently adhered to surface 130, more preferably it is releaseably attached to the tool head so as to cover the working surface 130. Thus in the case of tool 120, the abrasive cover member is in the form of a disposable swab shown generally 156 which can be packaged and marketed separately from the tool ala razor blades. Swab 156 includes an abrasive layer 158, e.g. of woven nylon, with a backing layer or pad 162 made of a porous, resilient or compliant material such as open cell foam. Preferably, a thin, non-stretchable, perforated or porous plastic strip 164 is sandwiched between layers 158 and 162 to add lateral stability to the swab. Adhered to the top surface of pad 162 is a slider 165 whose opposite side walls are turned inwardly to form keys 165*a* that are adapted to be slidably received in slots or keyways 166 formed in the opposite sides of the tool head 122*c*. Preferably, the keys 165*a* are angled slightly with respect to the plane of the slider 165 so that when the slider is slid onto head 122*c* as shown in FIG. 6, the keys 165*a* resiliently engage the walls of the keyways 166. Thus, the swab 156 remains secured to the tool head even when that head is vibrated.

When valve 134 is activated, solvent flows into head 122*c* and through holes or perforations 154 down into the various layers of swab 156. Thus when the transducer 124 is turned on by closing switch 128, the tool 120 can clean a finger or toe nail placed in contact with layer 158 by a combination of vibration and solvent action.

Other known means may be provided to releasably secure an abrasive layer 158 to working surface 130. For example, the slider 165 may be replaced by a clip member which clips to a mating clip member on working surface 130. Alternatively, a layer of loop material may be present at the upper surface of pad 162 in lieu of slider 164, that loop material being adhered to a layer of hook material on surface 130, i.e. a Velcro fastener connection.

A version of tool 120 may be provided which does not include a solvent supply. In that event, the tool neck 122*b* and head 122*c* may be solid and the solvent provided as a liquid or gel within the swab pad 162 or by dipping the swab in solvent as described above in connection with the FIGS. 2 and 3 tool embodiments.

Also, when the tool head and neck are solid, the head and swab may be formed as a disposable unit which may be releasably connected to the end of the neck 122*b*. For example, as shown in phanton in FIG. 5, the solid neck may be terminated by a tongue 166 with the head being formed with a slot 168 for slidably receiving the tongue, i.e. like a shoe. Promontories and dimples (not shown) on opposing surfaces of the tongue and slot may be provided to maintain the connection as the head vibrates.

Figure 7:
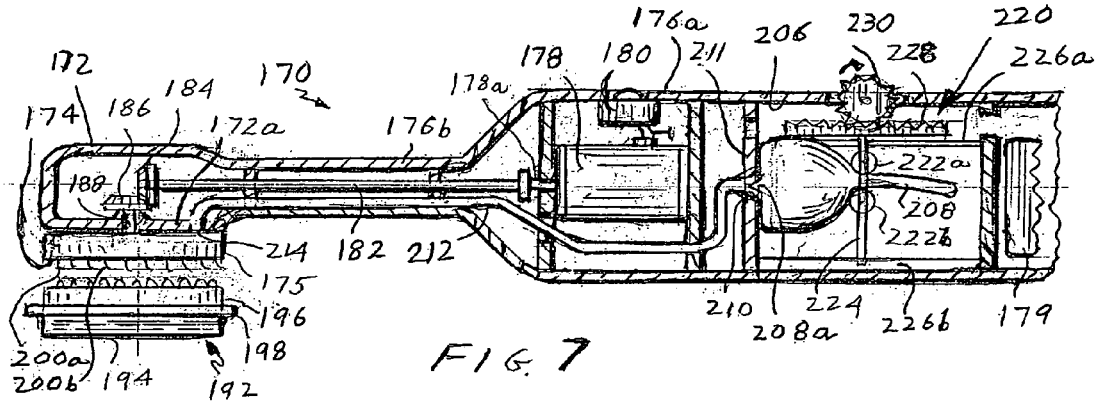
FIG. 7 is a view similar to FIG. 5 of still another tool embodiment.

Refer now to FIG. 7 which illustrates a tool embodiment 170 whose head 172 has a working surface 174 which rotates instead of vibrates. Tool 170 has a main body 176*a* and a neck 176*b* leading to head 172. Body 176*a* contains an electric motor 178 as the prime mover powered by a rechargeable battery 179 and controlled by a switch 180 mounted in the wall of main body 176*a* and electrically connected between the two. The armature 178*a* of motor 178 is coupled to one end of a shaft 182 rotatably mounted in neck 176*b*. The opposite end of shaft 182 is located in head 172 and carries a bevel gear 184 which meshes with a second, orthogonal bevel gear 186 connected to a stub shaft 188 rotatably mounted in a bottom wall 172*a* of head 172. The stub shaft 188 extends through bottom wall 172*a* and connects to working surface 174 which is part of a relatively stiff, rotatable, perforated pad 175.

Tool 170 is used in conjunction with an abrasive member in the form of a swab shown generally at 192 in FIG. 7. As before, swab includes an abrasive layer 194, a resilient or compliant pad 196, and a stabilizing perforated or porous strip or layer 198 sandwiched between the abrasive layer and pad. Also as before, means are provided for releasably securing the swab to the working surface 174. In the case of the FIG. 7 tool, those means constitute hook and loop fasteners 200*a* and 200*b* on the opposing surfaces of pads 175 and 196.

Figure 8:
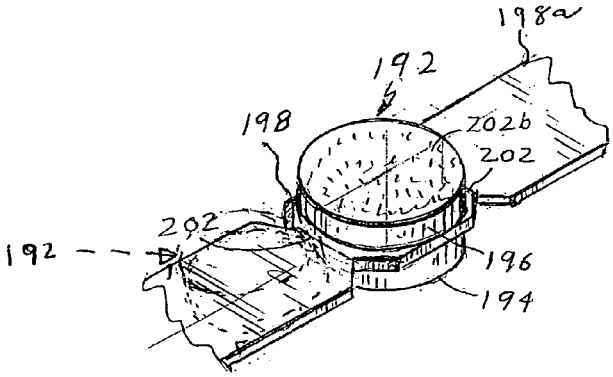
FIG. 8 is a fragmentary perspective view showing the genesis of the swab component of the FIG. 7 tool.

As shown in FIG. 8, the swabs 192 may be manufactured with strip 198 being part of a long continuous carrier strip 198*a* with each swab being separable from the others along transverse tear lines 202 formed in carrier strip 198*a*.

Referring to FIG. 7, the abrasive layer 194 may be wetted by providing the solvent in the swab pad 196 as described above in connection with the other abrasive member embodiments or by dipping the swab in a solvent. More preferably, however, the tool 170 includes a solvent supply in the tool itself. For this, the main body 176*a* has a compartment 206 between motor 178 and battery 179. That compartment includes a collapsible container 208 having a male outlet 208*a* which plugs into a female fitting 210 in a wall 211 and which is connected to one end of a tube 212 which extends along neck 176*b* into tool head 172. The other end of the tube leads to a hole 214 in the bottom wall 172*a*. When container 208 is compressed, the solvent is pumped along tube 212 and out through hole 214 whereupon the solvent drops onto the surface of the perforated pad 175 and flows into swab 192 even when the swab is rotating.

Container 208 may be collapsed by any suitable means such as the roller mechanism 220 illustrated generally in FIG. 7. As shown, the mechanism 220 comprises a pair of rollers 222*a* and 222*b* mounted to a carriage 224 whose upper and lower ends slide along slides 226*a* and 226*b*, respectively, present in compartment 206. The upper end of carriage 224 includes a horizontal rack 228 which is engaged by a toothed thumb wheel 230 rotatably mounted in the wall of main body 176*a* and accessible from the outside. When the wheel 230 is rotated clockwise, the rack is moved in a direction causing rollers to 222*a* and 222*b* to squeeze the container 208 thereby pumping solvent to swab 192.

It will be seen from the forgoing that my various tool embodiments provide a very efficient means for removing nail polish from finger and toe nails and for generally cleaning and buffing such nails. The tools are easy to use even by aged and infirm individuals and, since the solvent is confined to the tool head and its cover member, the toxic and noxious effects of the solvent are kept away from the user. Therefore, the tools should prove to be very marketable toiletry items.

It will thus be seen that the objects set forth above, among those made apparent from the preceding description, are efficiently attained. Also, certain changes may be made in the above constructions without departing from the scope of the invention. For example, the AC/DC converter could be incorporated into tool itself. Also, the solvent container may be of the aerosol type activated by pushing against the end of the container in the manner of an inhaler. In addition, the head of the housing may be connected to the main body thereof by a long flexible cable capable of conveying rotary or vibrational motion as well as solvent to the working surface of the head, i.e., the housing may be split into two sections. In this way, the motor, battery, solvent container and other heavier components of the tool may be in a housing main body resting on a table so that the user only has to support and manipulate the relatively lightweight head. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A hand held nail polish removal tool comprising:

a housing including a hollow main body and a hollow head having a perforated movable working surface and a periphery, said head being connected to the main body;

an abrasive member having a perforated abrasive surface and a porous backing in fluid communication with the abrasive surface, said member being shaped and arranged for attachment to the head so that said backing is flush against the working surface of the head;

a securement removably securing the abrasive member to the head;

a prime mover in the housing for moving the working surface;

a power supply;

a switch connected between the power supply and the prime mover and being accessible from outside the housing for selectively delivering power to the prime mover;

a solvent container in said housing, and means in the housing and accessible from outside the housing for delivering solvent from said container to said head under pressure so that the solvent penetrates said working and said abrasive surfaces.

2. The tool defined in claim 1 wherein the abrasive surface comprises a woven nylon swab with a compliant porous backing.

3. The tool defined in claim 1 and further including a supply of solvent in the container.

4. The tool defined in claim 3 wherein the solvent is in the form of a liquid or a gel.

5. The tool defined in claim 1 wherein the power supply includes a battery in the housing.

6. The tool defined in claim 1 wherein said abrasive member comprises a swab having a porous layer that provides said porous backing, a woven nylon layer that provides said abrasive surface and a flexible non-stretchable stabilizing layer sandwiched between said porous and said woven nylon layers.

7. The tool defined in claim 6 wherein said securement includes cooperating retainers on said working surface and said porous layer.

8. The tool defined in claim 6 and further including a body of solvent between said abrasive surface and said working surface.

9. The tool in defined in claim 8 wherein the solvent is contained in the porous layer.

10. The tool defined in claim 1 wherein:

said working surface is rotatable, and the prime motor includes an electric motor in the housing for rotating the working surface.

11. A hand held nail polish removal tool comprising:

a housing including a hollow main body and a head having a movable working surface and a periphery, said head being connected to the main body;

an abrasive member having a perforated abrasive surface and a body of solvent gel covering a rear face of said abrasive surface, said member being shaped and arranged to cover the working surface of the head;

a securement removably securing the abrasive member to the working surface;

a prime mover in said housing for moving the working surface;

a power supply in the housing, and a switch connected between the power supply and the prime mover and being accessible from outside the housing for selectively delivering power to the prime mover.

12. The tool defined in claim 11 wherein the prime mover includes a motor that rotates the working surface.

13. The tool defined in claim 11 wherein the prime mover includes a transducer that vibrates the working surface.

14. The tool defined in claim 11 wherein the abrasive member comprises a woven nylon layer that provides said abrasive surface and a compliant layer backing up the said woven nylon layer.

15. The tool defined in claim 14 wherein the gel is contained in said compliant layer.

16. A hand held nail polish removal tool comprising:

a housing including a hollow main body and a head having a working surface, said head being connected to the main body;

a cover member having a polish-collecting rubbing layer of a first material and a separate porous solvent carrying layer of a second material in fluid communication with the rubbing layer, said member being shaped and arranged for attachment to the head so that the member is flush against the working surface of the head;

a securement removably securing the member to the working surface;

a prime mover in said housing for moving the working surface;

a power supply in the housing, and a switch connected between the power supply and the prime mover and being accessible from outside the housing for selectively delivering power to the prime mover.

17. The tool defined in claim 16 and further including a body of solvent in said solvent carrying layer.

18. The tool defined in claim 16 wherein the member includes a flexible porous carrier sandwiched between the rubbing layer and the solvent carrying layer.

19. The tool defined in claim 16 wherein:

the working surface is rotatable, and the prime mover is an electric motor in the housing which rotates the working surface.

20. The tool defined in claim 16 wherein the securement includes cooperating retainers on said working surface and said member.

* * * * *